US008284134B2

(12) United States Patent
Park et al.

(10) Patent No.: US 8,284,134 B2
(45) Date of Patent: Oct. 9, 2012

(54) DISPLAY DEVICE AND DRIVING METHOD THEREOF

(75) Inventors: Seong-Il Park, Seoul (KR); Kyung-Hoon Kim, Uiwang-si (KR)

(73) Assignee: Samsung Display Co., Ltd., Yongin (KR)

( * ) Notice: Subject to any disclaimer, the term of this patent is extended or adjusted under 35 U.S.C. 154(b) by 1009 days.

(21) Appl. No.: 12/264,724

(22) Filed: Nov. 4, 2008

(65) Prior Publication Data

US 2009/0207158 A1 Aug. 20, 2009

(30) Foreign Application Priority Data

Feb. 15, 2008 (KR) ..... 10-2008-0014174

(51) Int. Cl.
*G09G 3/32* (2006.01)

(52) U.S. Cl. ..... 345/82; 345/76

(58) Field of Classification Search ..... 345/36, 345/39, 76, 77, 82, 92, 204, 211, 690; 315/169.1, 315/169.2, 169.3; 313/498, 500
See application file for complete search history.

(56) References Cited

U.S. PATENT DOCUMENTS

| | | | | |
|---|---|---|---|---|
| 8,188,946 | B2 * | 5/2012 | Nathan et al. | 345/77 |
| 2005/0068271 | A1 | 3/2005 | Lo | |
| 2005/0093799 | A1 | 5/2005 | Lo | |

FOREIGN PATENT DOCUMENTS

| | | |
|---|---|---|
| JP | 2001343933 | 12/2001 |
| JP | 2004246064 | 9/2004 |
| JP | 2006023402 | 1/2006 |
| JP | 2007114286 | 5/2007 |
| KR | 1020010052029 | 6/2001 |
| KR | 1020060135434 | 12/2006 |
| KR | 100690047 | 2/2007 |
| KR | 1020070037147 | 4/2007 |
| KR | 1020070040149 | 4/2007 |
| KR | 1020070053908 | 5/2007 |
| KR | 1020070059403 | 6/2007 |

* cited by examiner

*Primary Examiner* — Abbas Abdulselam
(74) *Attorney, Agent, or Firm* — H.C. Park & Associates, PLC

(57) ABSTRACT

A display device includes a light emitting element to emit light having an intensity that varies depending on a magnitude of a driving current, a capacitor connected between a first node and a second node, a driving transistor having an input terminal connected to a first voltage, an output terminal, and a control terminal connected to the second node, a first switching unit to connect a data voltage and a second voltage to the first node, a second switching unit to switch a connection between the second voltage and the second node, a third switching unit to connect the second node and the light emitting element to the output terminal of the driving transistor, and a fourth switching unit to switch a connection between the control terminal and the input terminal of the driving transistor.

22 Claims, 10 Drawing Sheets

DISPLAY DEVICE AND DRIVING METHOD THEREOF

CROSS-REFERENCE TO RELATED APPLICATION

This application claims priority from and the benefit of Korean Patent Application No. 10-2008-0014174, filed on Feb. 15, 2008, which is hereby incorporated by reference for all purposes as if fully set forth herein.

BACKGROUND OF THE INVENTION

1. Field of the Invention

The present invention relates to a display device and a driving method thereof, and more particularly, to an organic light emitting device and a driving method thereof.

2. Discussion of the Background

A hold-type flat panel display, such as an organic light emitting device, displays an image during a time period, for example, during a single frame, regardless of whether the image is a still image or motion image. For example, when an image of a continuously moving object is displayed, the movement of the object is discretely displayed such that the object stays at a particular position during one frame and then, during the next frame, the object stays at a position to which the object has moved after one frame. Because the afterimage is maintained during the time period of a frame, this method of display may effectively represent the continuous movement of the object.

However, the user's eyes continuously move on a screen along the movement of the object, and the continuous movement of the user's eyes conflicts with the discrete displaying scheme, which may cause blurring of an image. For example, it is assumed that a display device displays an image of the object such that the object stays at a position A during a first frame and the object stays at a position B during a second frame. During the first frame, the user's eyes move along an expected movement path of the object from position A to position B. In this respect, however, the object is not actually displayed at the intermediate positions between the positions A and B.

Consequently, the luminance recognized by the user during the first frame is equal to a value obtained by integrating the luminance of pixels in the path between the positions A and B, namely, a value obtained by appropriately averaging the luminance of the object and that of the background, which may cause the object to be blurred.

In the hold-type display device, since the degree of the blurring of the image of the object is proportional to a time period during which the display device maintains display of images, an impulse driving method has been proposed in which an image is displayed only for a limited portion of one frame and a black color is displayed for the remaining portion of the frame. In the impulse driving method, the luminance is reduced since the time period for actually displaying an image is reduced. Thus, a method for increasing the luminance during the display time and a method for displaying a median luminance with adjacent frames instead of a black color have been proposed. However, such methods may result in an increase in power consumption and a complicated driving scheme.

Each pixel in the organic light emitting device includes an organic light emitting element and a thin film transistor (TFT) to drive the organic light emitting element. When the light emitting elements and the TFTs operate for a long time, a threshold voltage thereof may change, thereby failing to provide an expected luminance. In addition, when the characteristics of semiconductors included in the TFTs are not uniform in the display device, luminance deviation among pixels may occur.

SUMMARY OF THE INVENTION

The present invention discloses a display device including a light emitting element to emit light having intensity that varies depending on a magnitude of a driving current, a capacitor connected between a first node and a second node, a driving transistor having an input terminal connected to a first voltage and an output terminal and a control terminal connected to the second node, a first switching unit to connect a data voltage and a second voltage to the first node, a second switching unit to switch a connection between the second voltage and the second node, a third switching unit to connect the second node and the light emitting element to the output terminal of the driving transistor, and a fourth switching unit to switch a connection between the control terminal and the input terminal of the driving transistor.

The present invention also discloses a display device including a light emitting element, a first capacitor connected between a first node and a second node, a driving transistor having an input terminal connected to a first voltage, an output terminal, and a control terminal connected to the second node, a first switching transistor controlled by a first control signal and connected between a data voltage and the first node, a second switching transistor controlled by the first control signal and connected between a second voltage and the first node, a third switching transistor controlled by the second control signal and connected between the second node and the second voltage, a fourth switching transistor controlled by the first control signal and connected between the second node and the output terminal of the driving transistor, a fifth switching transistor controlled by the first control signal and connected between the light emitting element and the output terminal of the driving transistor, and a sixth switching transistor controlled by a third control signal and connected between the control terminal and the input terminal of the driving transistor.

The present invention also discloses a method for driving a display device including a light emitting element, a capacitor connected between a first node and a second node, and a driving transistor having an input terminal, an output terminal, and a control terminal connected to the second node. The method includes connecting a data voltage to the first node while connecting the second node to the output terminal of the driving transistor, connecting a second voltage to the second node, disconnecting the second node from the second voltage, connecting the second voltage to the first node and connecting the light emitting element to the output terminal of the driving transistor, and connecting the control terminal and the input terminal of the driving transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
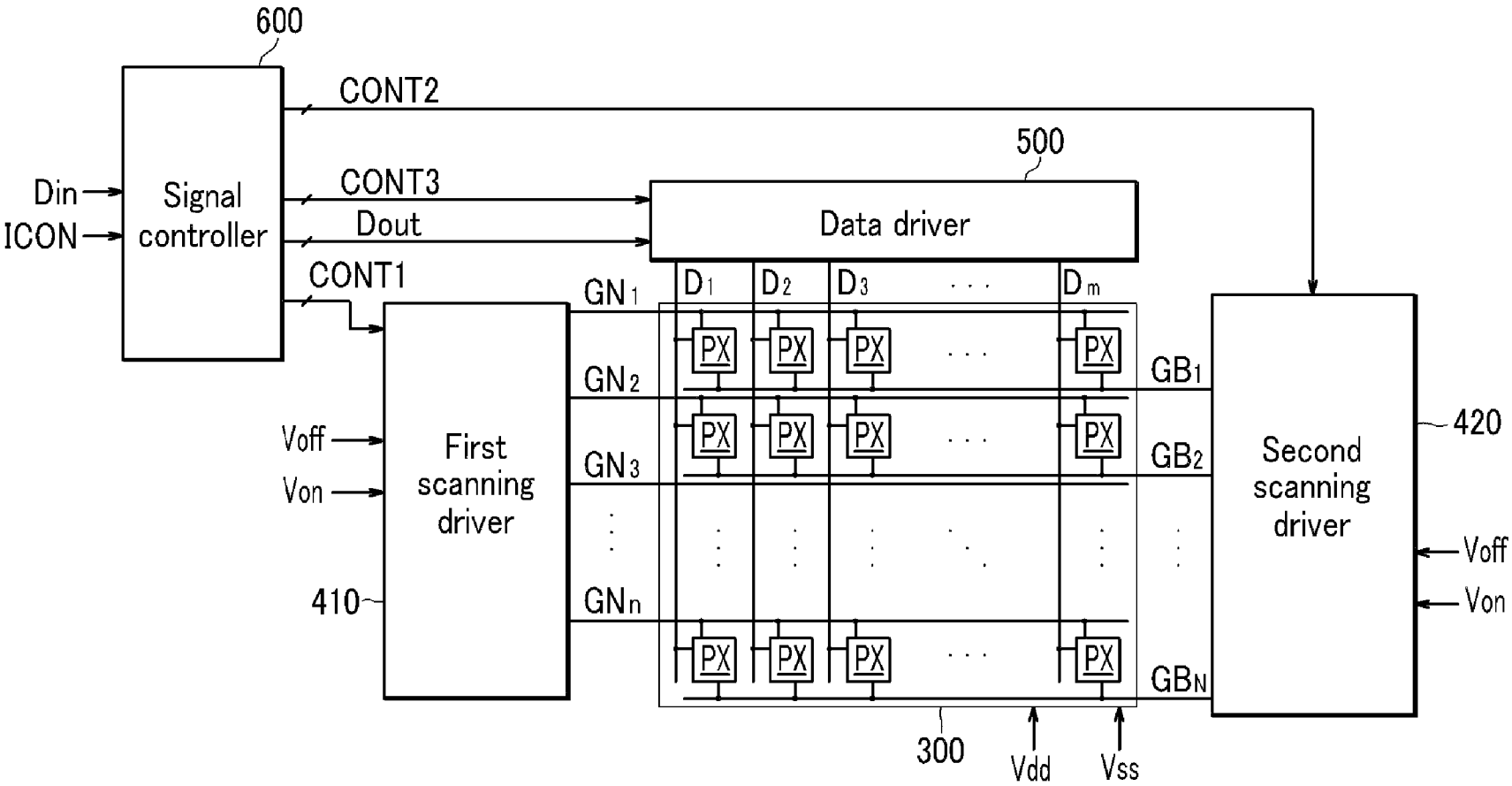
FIG. 1 is a schematic block diagram of an organic light emitting device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

First, an organic light emitting device according to an exemplary embodiment of the present invention will now be described with reference to FIG. 1, FIG. 2, and FIG. 3.

Figure 2:
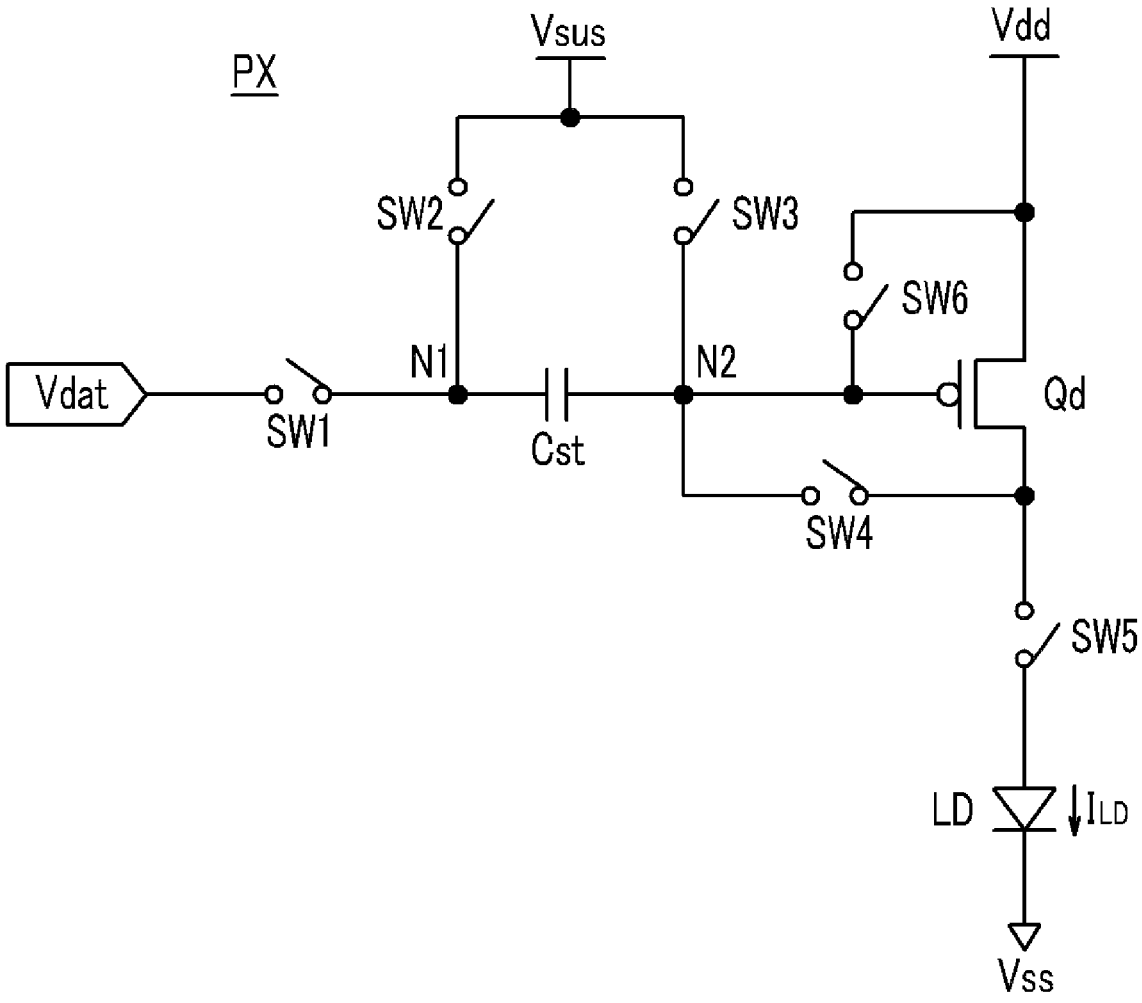
FIG. 2 and FIG. 3 are equivalent circuit diagrams of a single pixel in the organic light emitting device according to an exemplary embodiment of the present invention.
Figure 3:
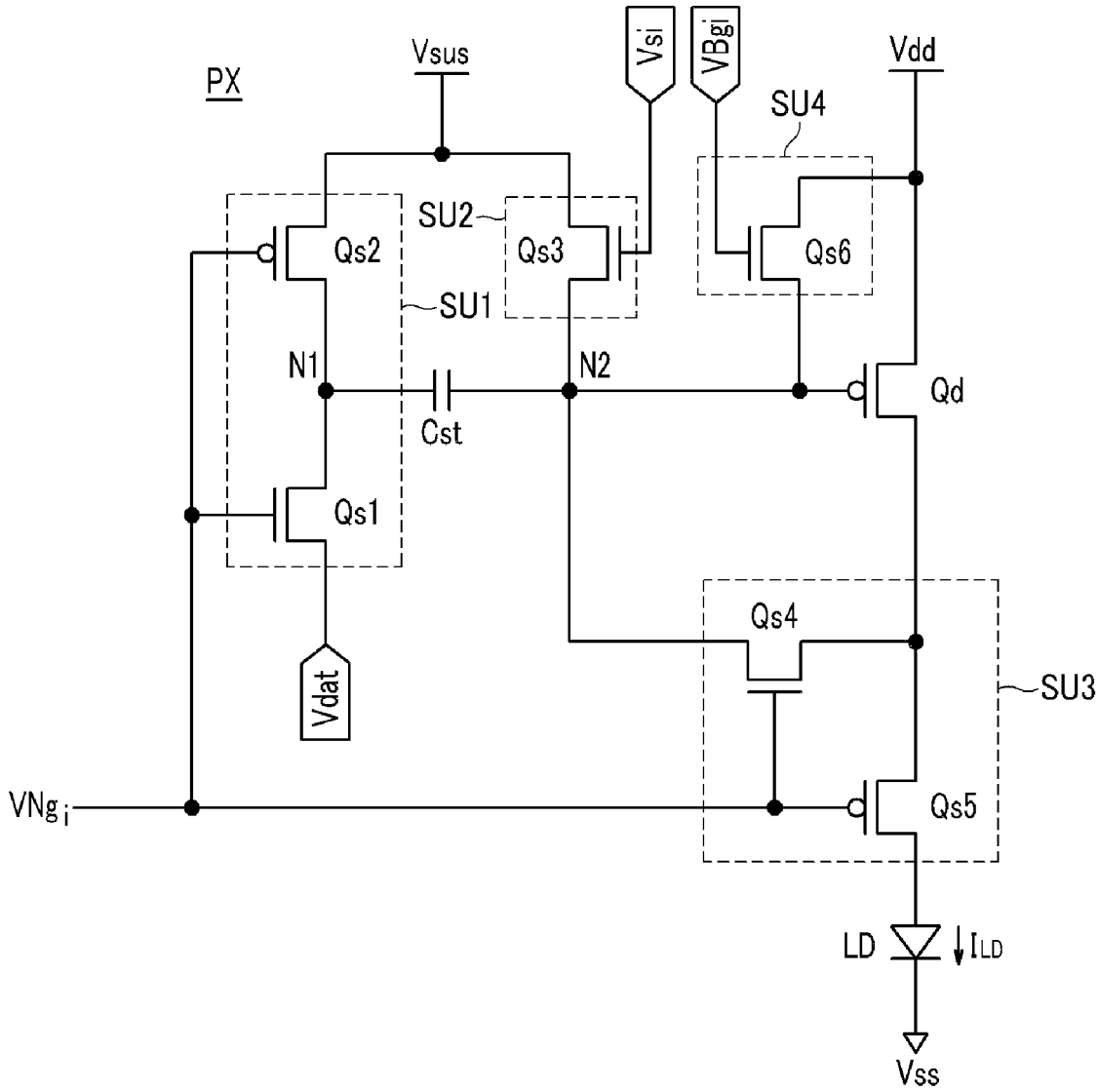

FIG. 1 is a schematic block diagram of an organic light emitting device according to an exemplary embodiment of the present invention, and FIG. 2 and FIG. 3 are equivalent circuit diagrams of a pixel in the organic light emitting device according to an exemplary embodiment of the present invention.

With reference to FIG. 1, an organic light emitting device according to an exemplary embodiment of the present invention includes a display panel 300, a first scanning driver 410, a second scanning driver 420, a data driver 500, and a signal controller 600.

The display panel 300 includes a plurality of signal lines $GN_1$-$GN_n$, $GB_1$-$GB_n$, and $D_1$-$D_m$, a plurality of voltage lines (not shown), and a plurality of pixels (PX) connected to the signal lines and the voltage lines and arranged substantially in a matrix form.

The signal lines $GN_1$-$GN_n$, $GB_1$-$GB_n$, and $D_1$-$D_m$ include a plurality of first scanning signal lines $GN_1$-$GN_n$ that transmit first scanning signals, a plurality of second scanning signal lines $GB_1$-$GB_n$ that transmit second scanning signals, and a plurality of data lines $D_1$-$D_m$ that transmit data signals. The first and second scanning signal lines $GN_1$-$GN_n$ and $GB_1$-$GB_n$ extend substantially in a row direction parallel to each other, and the data lines $D_1$-$D_m$ extend substantially in a column direction parallel to each other.

The voltage lines include voltage transmission lines (not shown) that transmit voltages such as a driving voltage.

As shown in FIG. 2, each pixel PX includes an organic light emitting element LD, a driving transistor Qd, a capacitor Cst, and six switches SW1, SW2, SW3, SW4, SW5, and SW6. The first, second, third, fourth, fifth, and sixth switches SW1, SW2, SW3, SW4, SW5, and SW6 shown in FIG. 2 may be switching transistors Qs1, Qs2, Qs3, Qs4, Qs5, and Qs6, as shown in FIG. 3, so the description of the switches SW1, SW2, SW3, SW4, SW5, and SW6 will be replaced with the description of the switching transistors Qs1, Qs2, Qs3, Qs4, Qs5, and Qs6.

The driving transistor Qd has an output terminal, an input terminal, and a control terminal. The control terminal of the driving transistor Qd is connected to the capacitor Cst at a node N2, the input terminal of the driving transistor Qd is connected to a driving voltage Vdd, and the output terminal of the driving transistor Qd is connected to the switching transistor Qs5.

The capacitor Cst has one terminal connected to the driving transistor Qd at the node N2, and another terminal connected to the switching transistors Qs1 and Qs2 at a node N1.

The switching transistors Qs1, Qs2, Qs3, Qs4, Qs5, and Qs6 may be grouped into four switching units SU1, SU2, SU3, and SU4.

The switching unit SU1 connects either a data voltage Vdat or a sustain voltage Vsus to the node N1 in response to a first scanning signal $VNg_i$ (i=1, 2, . . . , N), and includes the two switching transistors Qs1 and Qs2. The switching transistor Qs1 is connected between the node N1 and the data voltage Vdat, and the switching transistor Qs2 is connected between the node N1 and the sustain voltage Vsus.

The switching unit SU2 connects or disconnects the sustain voltage Vsus and the node N2 in response to a compensation signal $Vs_i$, and includes the switching transistor Qs3 connected between the sustain voltage Vsus and the node N2. On the display panel 300, a compensation signal line (not shown) that transmits the compensation signal $Vs_i$ may be substantially parallel to the first and second scanning signal lines $GN_1$-$GN_n$ and $GB_1$-$GB_n$.

The switching unit SU3 connects either the node N2 or the organic light emitting element LD to the output terminal of the driving transistor Qd in response to the first scanning signal $VNg_i$, and includes two switching transistors Qs4 and Qs5. The switching transistor Qs4 is connected between the output terminal of the driving transistor Qd and the node N2, and the switching transistor Qs5 is connected between the output terminal of the driving transistor Qd and the organic light emitting element LD.

The switching unit SU4 connects or disconnects the control terminal and the input terminal of the driving transistor Qd in response to the second scanning signal $VBg_i$, and includes the switching transistor Qs6 connected between the control terminal and the input terminal of the driving transistor Qd.

The switching transistors Qs1, Qs3, Qs4, and Qs6 are n-channel field effect transistors (FETs), and the switching transistors Qs2 and Qs5 and the driving transistor Qd are p-channel FETs. An example of an FET is a thin film transistor (TFT) that includes polycrystalline silicon or amorphous silicon. The channel types of the switching transistors Qs1, Qs2, Qs3, Qs4, Qs5, and Qs6 and the driving transistor Qd may be interchanged, and in this case, waveforms of signals to drive them may be reversed.

The organic light emitting element LD has an anode connected to the switching transistor Qs5 and a cathode connected to a common voltage Vss. The organic light emitting element LD emits light with intensity that varies according to the magnitude of a current $I_{LD}$ supplied by the driving transistor Qd via the switching transistor Qs5, to display an image accordingly, and the magnitude of the current $I_{LD}$ is dependent upon the magnitude of a voltage between the control terminal and the input terminal of the driving transistor Qd.

Referring back to FIG. 1, the first scanning driver 410 is connected to the first scanning signal lines $GN_1$-$GN_n$ of the display panel 300, and synthesizes a high voltage Von and a low voltage Voff to generate the first scanning signals $VNg_1$-$VNg_n$ for application to the first scanning signal lines $GN_1$-$GN_n$. Likewise, the second scanning driver 420 is connected to the second scanning signal lines $GB_1$-$GB_n$ of the display panel 300, and synthesizes a high voltage Von and a low voltage Voff to generate the second scanning signals $VBg_1$-$VBg_n$ for application to the second scanning signal lines $GB_1$-$GB_n$.

When compensation signal lines are disposed on the display panel 300, the organic light emitting device according to the present exemplary embodiment may further include another scanning driver (not shown) that is connected to the compensation signal lines and synthesizes a high voltage Von and a low voltage Voff to generate the compensation signals $Vs_1$-$Vs_n$ for application to the compensation signal lines.

The high voltage Von causes the switching transistors Qs1, Qs3, Qs4, and Qs6 to be turned on and the switching transistors Qs2 and Qs5 to be turned off, and the low voltage Voff causes the switching transistors Qs1, Qs3, Qs4, and Qs6 to be turned off and the switching transistors Qs2 and Qs5 to be turned on. The sustain voltage Vsus is a low voltage, and like the low voltage Voff, the sustain voltage Vsus causes the switching transistors Qs1, Qs3, Qs4, and Qs6 to be turned off and the switching transistors Qs2 and Qs5 to be turned on. The sustain voltage Vsus and the driving voltage Vdd may be applied through voltage transmission lines.

The data driver 500 is connected to the data lines $D_1$-$D_m$ and applies the data voltages Vdat corresponding to image signals to the data lines $D_1$-$D_m$.

The signal controller 600 controls the first and second scanning drivers 410 and 420, the data driver 500, the additional scanning driver, etc.

Each driving apparatus 410, 420, 500, and 600 may include at least one integrated circuit (IC) chip (not shown) mounted on the display panel 300 or on a flexible printed circuit (FPC) film (not shown) in a tape carrier package (TCP) type, which is attached to the panel assembly 300. Alternatively, the driving apparatus 410, 420, 500, and 600 may be mounted on a separate printed circuit board (PCB) (not shown). In another option, at least one driving apparatus 410, 420, 500, and 600 may be integrated into the display panel 300 together with the signal lines GN1-$GN_n$, GB1-$GB_n$, and D1-$D_m$ and the transistors Qs1, Qs2, Qs3, Qs4, Qs5, Qs6, and Qd. Further, all of the driving apparatuses 410, 420, 500, and 600 may be integrated into a single IC chip, and in this case, at least one of circuit elements therein may be positioned outside the single IC chip.

The operation of the organic light emitting device will now be described with reference to FIG. 1, FIG. 3, FIG. 4, FIG. 5, FIG. 6, FIG. 7, FIG. 8, FIG. 9, and FIG. 10.

Figure 4:
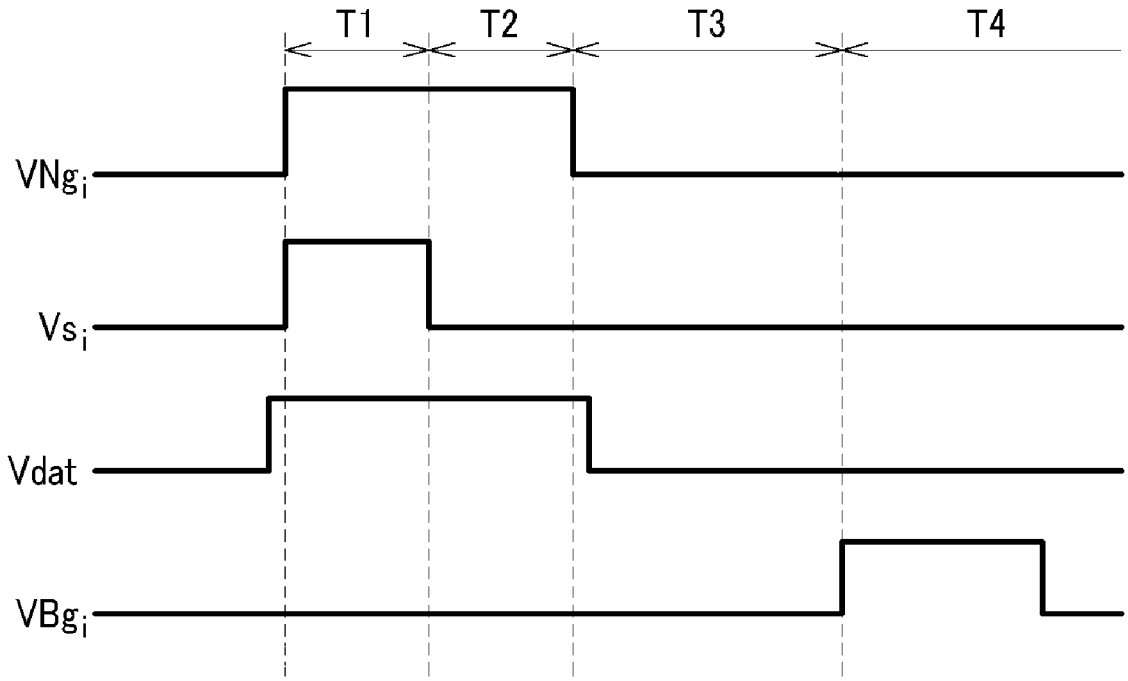
FIG. 4 shows waveforms of driving signals applied to a row of pixels in the organic light emitting device according to an exemplary embodiment of the present invention.
Figure 7:
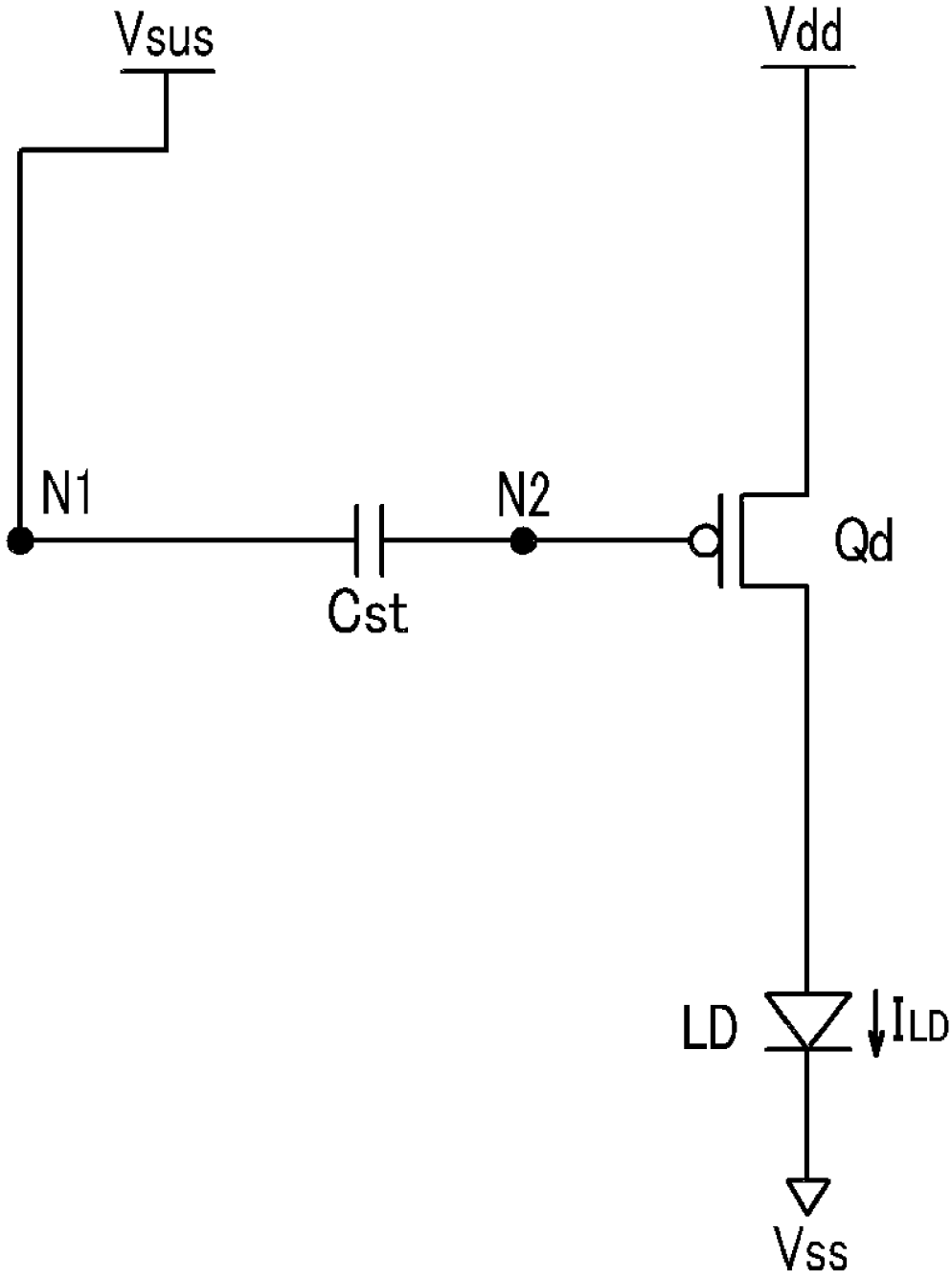
Figure 8:
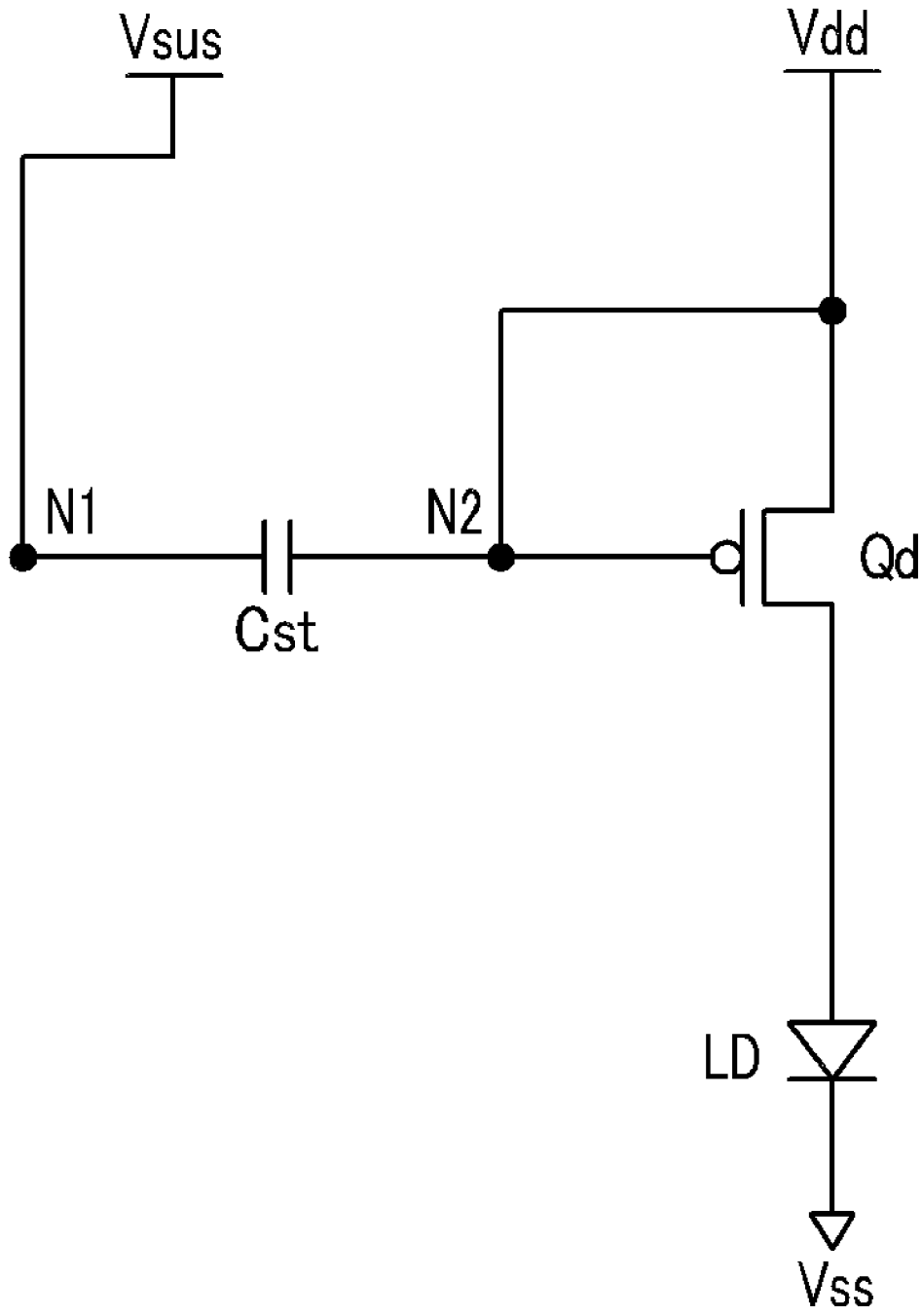
Figure 9:
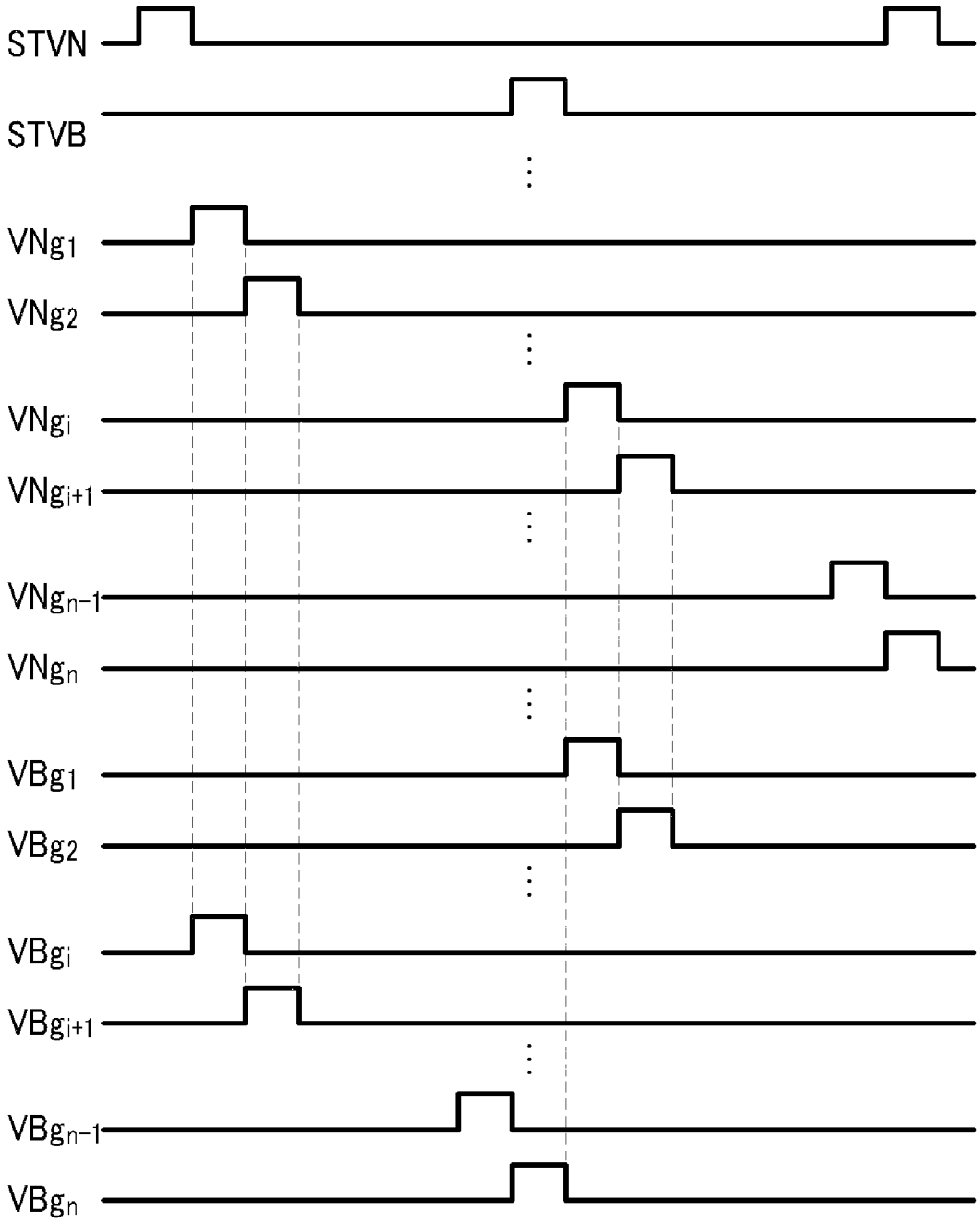
FIG. 9 and FIG. 10 show waveforms of driving signals of the organic light emitting device according to an exemplary embodiment of the present invention.
Figure 10:
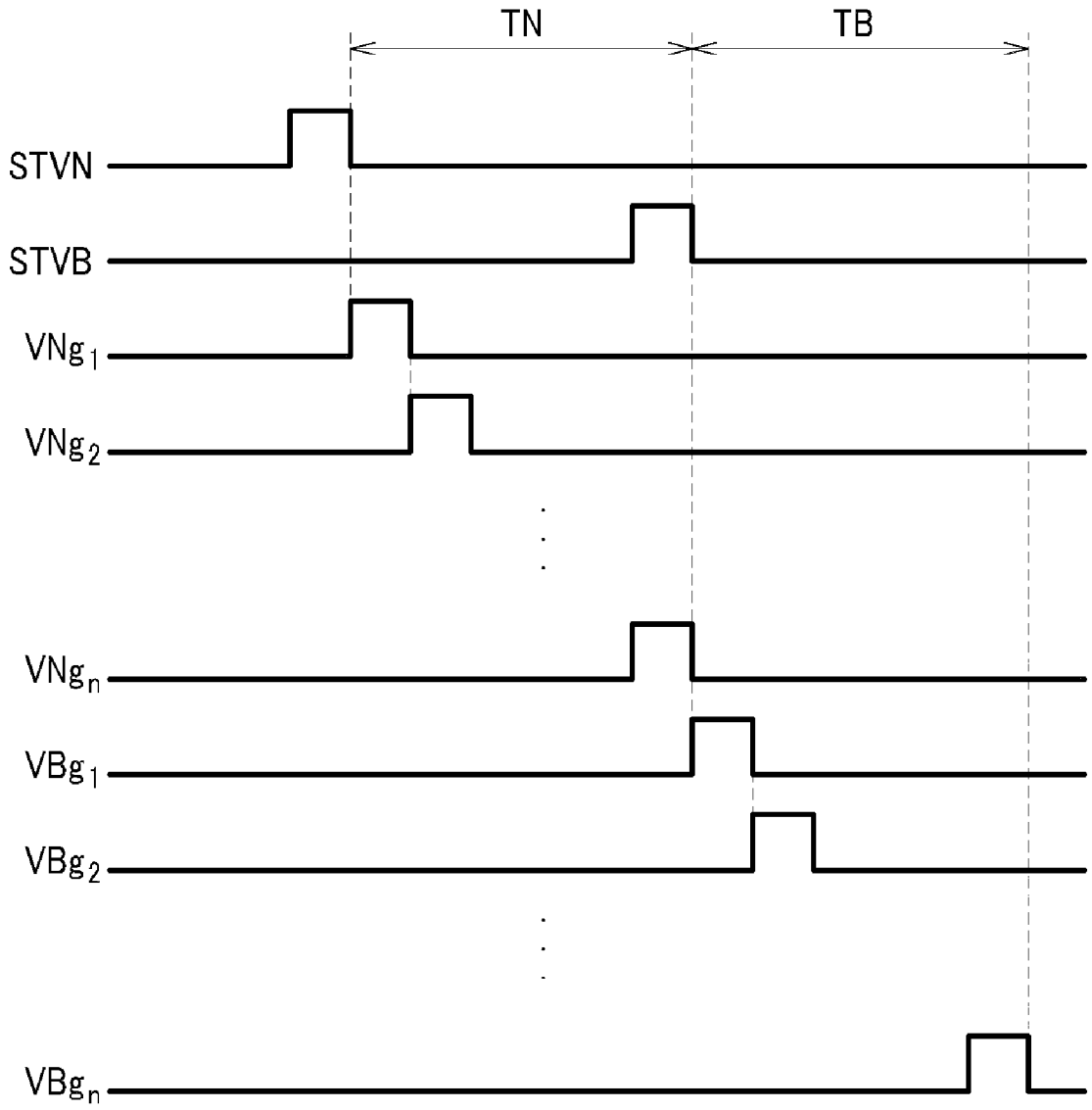

FIG. 4 shows waveforms of driving signals applied to a row of pixels in the organic light emitting device according to an exemplary embodiment of the present invention, FIG. 5, FIG. 6, FIG. 7, and FIG. 8 are equivalent circuit diagrams of a pixel at respective periods as shown in FIG. 4, and FIG. 9 and FIG. 10 show waveforms of driving signals of the organic light emitting device according to an exemplary embodiment of the present invention.

The signal controller 600 receives input image signals Din and input control signals ICON to control the display thereof from an external graphics controller (not shown). The input image signals Din contain luminance information of pixels PX, and the luminance has a number of grays, for example 1024 ($=2^{10}$), 256 ($=2^8$), or 64 ($=2^6$) grays. The input control signals ICON may include a vertical synchronization signal, a horizontal synchronization signal, a main clock signal, a data enable signal, etc.

On the basis of the input control signals ICON and the input image signals Din, the signal controller 600 generates first and second scanning control signals CONT1 and CONT2 and data control signals CONT3, etc., and it processes the input image signals Din suitable for the operation of the display panel 300. The signal controller 600 sends the first scanning control signals CONT1 to the first scanning driver 410, the second scanning control signals CONT2 to the second scanning driver 420, and the data control signals CONT3 and output image signals Dout to the data driver 500.

The first scanning control signals CONT1 include a first vertical synchronization start signal STVN to initiate scanning of the high voltage Von to the first scanning signal lines $GN_1$-$GN_n$ and at least one clock signal to control an output period of the high voltage Von. The first scanning control signals CONT1 may further include an output enable signal to define the duration of the high voltage Von.

The second scanning control signals CONT2 include a second vertical synchronization start signal STVB to initiate scanning of the high voltage Von to the second scanning signal lines $GBN_1$-$GB_n$, and at least one clock signal to control an output period of the high voltage Von, etc. The second scanning control signals CONT2 may further include an output enable signal to define the duration of the high voltage Von.

The data control signals CONT3 includes a horizontal synchronization start signal to initiate transmission of the output image signals Dout for a row of pixels PX, a load signal to initiate application of the analog data voltages to the data lines $D_1$-$D_m$, a data clock signal HCLK, etc.

The signal controller 600 may generate a compensation control signal to control the compensation signal $Vs_i$.

A particular row of pixels, e.g., the $i^{th}$ pixel row, will be focused on for description.

Responsive to the data control signals CONT3 from the signal controller 600, the data driver 500 receives the digital output image signals Dout for the $i^{th}$ row of pixels PX, converts the output image signals Dout into analog data voltages Vdat, and applies the same to the corresponding data lines $D_1$-$D_m$.

The first scanning driver 410 changes the first scanning signal $VNg_i$ applied to the first scanning signal line $GN_i$ to the high voltage Von in response to the first scanning control signals CONT1 from the signal controller 600. At the same time, the compensation signal $Vs_i$ is changed to the high voltage Von, and the second scanning signal $VBg_i$ applied to the second scanning signal line $GB_i$ maintains the low voltage Voff state.

Then, the switching transistors Qs1, Qs3, and Qs4 are turned on, the switching transistors Qs2 and Qs5 are turned off, and the switching transistor Qs6 maintains an off state.

Figure 5:
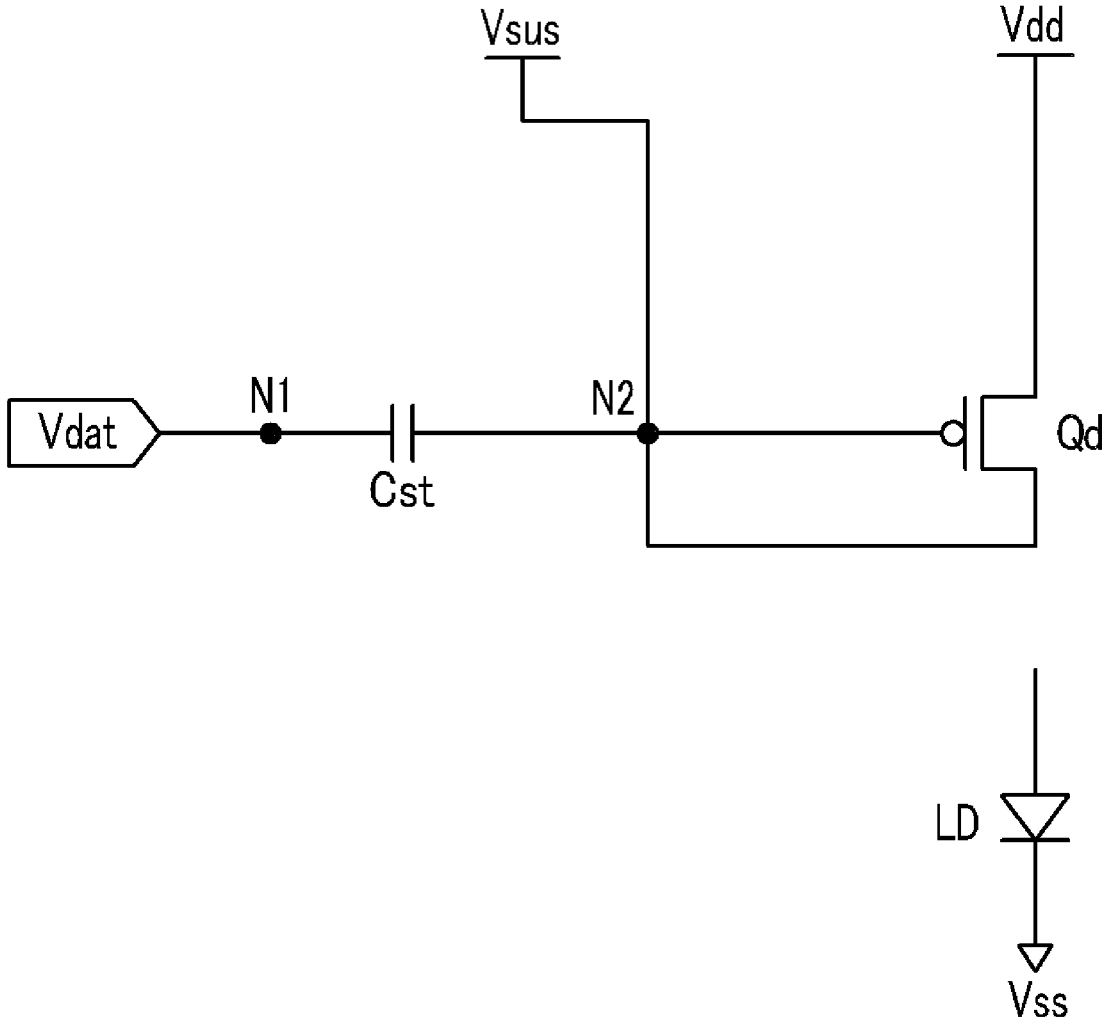
FIG. 5, FIG. 6, FIG. 7, and FIG. 8 are equivalent circuit diagrams of a single pixel at each period shown in FIG. 4.

An equivalent circuit of the pixel PX in such a state is shown in FIG. 5, and this period is referred to as an initialization period T1.

As shown in FIG. 5, the data voltage Vdat is applied to the node N1 and the sustain voltage Vsus is applied to the node N2, and the voltage difference between the two nodes N1 and N2 is stored in the capacitor Cst. Accordingly, the driving transistor Qd is turned on to generate a current. However, the organic light emitting element LD does not emit light since the switching transistor Qs5 is turned off.

Subsequently, as the compensation signal $Vs_i$ is changed to the low voltage Voff and the switching transistor Qs3 turns off, a compensation period T2 starts. Since the first scanning signal $VNg_i$ maintains the high voltage Von during the period T2, the switching transistors Qs1, Qs3, and Qs4 maintain their on states and the switching transistors Qs2 and Qs5 maintain their off states. Since the second scanning signal $VBg_i$ maintains the low voltage Voff during the compensation period T2, the switching transistor Qs6 also maintains its off state.

Figure 6:
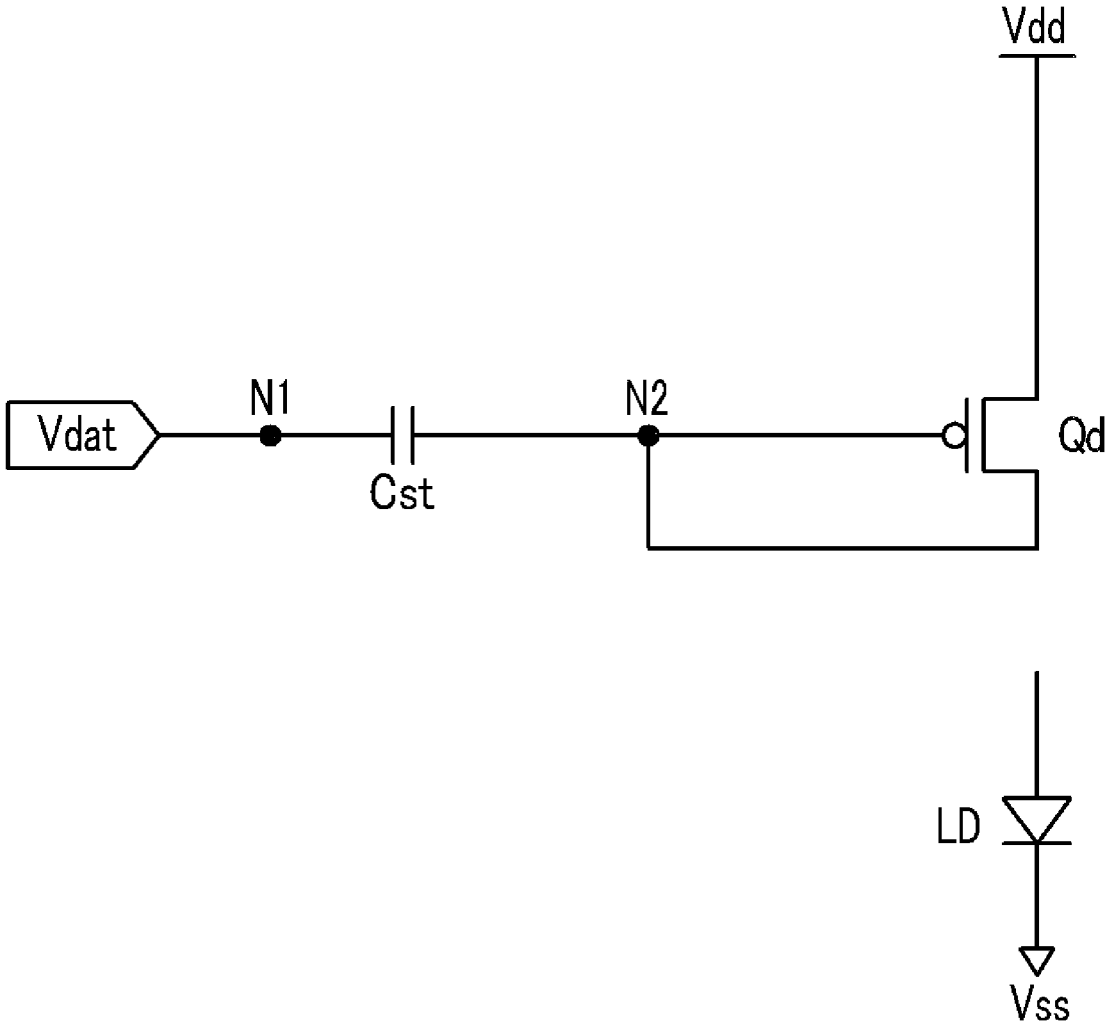

Then, as shown in FIG. 6, the node N2 is disconnected from the sustain voltage Vsus. In this case, because the driving transistor Qd maintains the on state, electric charges stored in the capacitor Cst are discharged through the driving transistor Qd. This discharging continues unless the voltage difference between the control terminal and the input terminal of the driving transistor Qd reaches a threshold value Vth of the driving transistor Qd. Namely, when the voltage difference reaches the threshold voltage Vth, the discharging stops.

Thus, a voltage $V_{N2}$ of the node N2 is converged into a value expressed by Eq. 1 shown below.

$$V_{N2}=Vdd+Vth \quad \text{(Eq. 1)}$$

In this case, because a voltage $V_{N1}$ at the node N1 maintains the data voltage Vdat, the voltage stored in the capacitor Cst is given by:

$$V_{N1}-V_{N2}=Vdat-(Vdd+Vth). \quad \text{(Eq. 2)}$$

Thereafter, the first scanning driver 410 changes the first scanning signal $VNg_i$ to the low voltage Voff to turn off the switching transistors Qs1 and Qs4 and to turn on the switching transistors Qs2 and Qs5, thereby causing a light emission period T3 to start. Since the compensation signal $Vs_i$ and the second scanning signal $VBg_i$ still maintain the low voltage Voff during the light emission period T3, the switching transistors Qs3 and Qs6 maintain their off states.

Then, as shown in FIG. 7, the node N1 is disconnected from the data voltage Vdat and connected to the sustain voltage Vsus, and the control terminal of the driving transistor Qd is floated.

Therefore, the voltage $V_{N2}$ of the node N2 is given by:

$$V_{N2}=Vdd+Vth-Vdat+Vsus. \quad \text{(Eq. 3)}$$

Meanwhile, because the switching transistor Qs5 is turned on, the output terminal of the driving transistor Qd is connected to the organic light emitting element LD, and the driving transistor Qd outputs the current $I_{LD}$ having a magnitude controlled by the voltage difference Vgs between the control terminal and the input terminal of the driving transistor Qd.

$$\begin{aligned} I_{LD} &= 1/2\times K\times(Vgs-Vth)^2 \quad \text{(Eq. 4)} \\ &= 1/2\times K\times(V_{N2}-Vdd-Vth)^2 \\ &= 1/2\times K\times(Vdd+Vth-Vdat+Vsus-Vdd-Vth)^2 \\ &= 1/2\times K\times(Vdat-Vsus)^2 \end{aligned}$$

Here, K=μ×Ci×W/L, which is a constant depending on the characteristics of the driving transistor Qd, where "μ" is field effect mobility, "Ci" is the capacitance of a gate insulating layer, "W" is a channel width of the driving transistor Qd, and "L" is a channel length of the driving transistor Qd.

According to Eq. 4, the output current $I_{LD}$ at the light emission period T3 is determined only by the data voltage Vdat and the fixed sustain voltage Vsus. Thus, the output current $I_{LD}$ is not affected by the threshold voltage Vth of the driving transistor Qd.

The output current $I_{LD}$ is supplied to the organic light emitting element LD, and the organic light emitting element LD emits light with intensity that varies depending on the magnitude of the output current $I_{LD}$, thereby displaying an image.

Therefore, a uniform image can be displayed regardless of positional and temporal variations of the threshold voltages Vth of the driving transistors Qd.

After the light emission period T3 continues for a period of time, the second scanning driver 420 changes the second scanning signal $VBg_i$ applied to the second scanning signal line $GB_i$ to the high voltage Von in response to the second scanning control signals CONT2 from the signal controller 600, causing an emission suspension period T4. During the period T4, the first scanning signal $VNg_i$ and the compensation signal $Vs_i$ maintain the low voltage state Voff, so only the switching transistor Qs6 is turned on and the remaining transistors Qs1, Qs2, Qs3, Qs4, and Qs5 maintain their off states.

Then, as shown in FIG. 8, the control terminal and the input terminal of the driving transistor Qd are interconnected, and accordingly, the voltage difference therebetween disappears and the driving transistor Qd can no longer generate the current. Then, the organic light emitting element LD does not emit light and the pixel PX turns black.

Once the control terminal and the input terminal of the driving transistor Qd have the same voltage, they maintain the same voltage even if the switching transistor Qs6 is turned off again, and thus the driving transistor Qd continues to generate no output current.

The emission suspension period T4 continues until before the initialization period T1 for the $i^{th}$ row of pixels PX returns at the next frame, and the operations of the respective periods T1, T2, T3, and T4 are repeatedly performed on the next row of pixels PX in the same manner.

Referring to FIG. 9 and FIG. 10, the first and second scanning drivers 410 and 420 start scanning in response to the first and second scanning start signals STVN and STVB with a time difference, e.g., a time difference of about a half of the frame. Thus, each pixel PX has the light emission period T3 for about a half of the frame and the emission suspension period T4 for a half of the frame. In addition, when viewed at a particular time point, about one half of the pixels PX emit light and the other half of the pixels PX do not emit light.

With reference to FIG. 9, the duration of the high voltage Von in the first scanning signals $VNg_1$ to $VNg_n$ and the duration of the high voltage Von in the second scanning signals $VBg_1$-$VBg_n$ overlap each other. In other words, while one of the first scanning signals $VNg_1$ to $VNg_n$ for a row of the pixels PX has the high voltage, one of the second scanning signals $VBg_1$ to $VBg_n$ for another row of the pixels PX also has the high voltage Von.

On the contrary, in case of FIG. 10, a period TN, in which the first scanning signals $VNg_1$ to $VNg_n$ have the high voltage Von, is separate from a period TB, in which the second scanning signals $VBg_1$ to $VBg_n$ have the high voltage Von. In other words, while each first scanning signal $VNg_1$ to $VNg_n$ for a row of the pixels PX has the high voltage Von, all the second scanning signals $VBg_1$ to $VBg_n$ have the low voltage Voff.

As a result, in the case shown in FIG. 9, the pixels PX can more stably operate than the pixels PX in the case of FIG. 10 because the duration of the high voltage applied to the pixels PX is relatively long.

The length of the respective periods T1, T2, T3, and T4 may be adjusted as necessary.

In this manner, impulse driving may be accomplished through a simple method.

As described above, the impulse driving may be accomplished with a pixel circuit including only six switching transistors, a driving transistor, a capacitor, and an organic light emitting element, and the deviation of the threshold voltages of the driving transistors may be compensated.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a light emitting element to emit light having an intensity that varies depending on a magnitude of a driving current;

a capacitor connected between a first node and a second node;

a driving transistor comprising an input terminal connected to a first voltage, an output terminal, and a control terminal, the control terminal being connected to the second node;

a first switching unit to connect a data voltage and a second voltage to the first node;

a second switching unit to switch a connection between the second voltage and the second node;

a third switching unit to connect the second node and the light emitting element to the output terminal of the driving transistor; and a fourth switching unit to switch a connection between the control terminal and the input terminal of the driving transistor.

2. The device of claim 1, wherein the fourth switching unit suspends light emission of the light emitting element by connecting the control terminal and the input terminal of the driving transistor to each other when the light emitting element is emitting light.

3. The device of claim 2, wherein the third switching unit connects the second node to the output terminal of the driving transistor while the first switching unit connects the data voltage to the first node.

4. The device of claim 3, wherein the third switching unit connects the light emitting element to the output terminal of the driving transistor while the first switching unit connects the second voltage to the first node.

5. The device of claim 4, wherein the second switching unit connects the second node to the second voltage and then disconnects the second node from the second voltage while the first switching unit connects the data voltage to the first node.

6. The device of claim 5, wherein the capacitor stores a threshold voltage of the driving transistor while the first switching unit connects the data voltage to the first node and the third switching unit connects the second node to the output terminal of the driving transistor.

7. The device of claim 6, wherein the first switching unit comprises:

a first switch to switch the connection between the data voltage and the first node; and a second switch to switch the connection between the second voltage and the first node.

8. The device of claim 7, wherein the second switching unit comprises a third switch.

9. The device of claim 8, wherein the third switching unit comprises:

a fourth switch to switch the connection between the second node and the output terminal of the driving transistor; and a fifth switch to switch the connection between the light emitting element and the output terminal of the driving transistor.

10. The device of claim 9, wherein the fourth switching unit comprises a sixth switch.

11. The device of claim 10, wherein the first switch, the second switch, the fourth switch, and the fifth switch are controlled by a first control signal.

12. The device of claim 11, wherein the first switch and the fourth switch are the same channel type, and the second switch and the fifth switch are the same channel type, the channel type of the second switch and the fifth switch being different from that of the first switch and the fourth switch.

13. The device of claim 12, wherein the third switch is controlled by a second control signal and is the same channel type as the first switch and the fourth switch.

14. The device of claim 12, wherein the sixth switch is controlled by a second control signal and is the same channel type as the first switch and the fourth switch.

15. The device of claim 12, wherein the driving transistor is the same channel type as the second switch and the fifth switch.

16. A display device, comprising:

a light emitting element;

a first capacitor connected between a first node and a second node;

a driving transistor comprising an input terminal connected to a first voltage, an output terminal, and a control terminal connected to the second node;

a first switching transistor controlled by a first control signal and connected between a data voltage and the first node;

a second switching transistor controlled by the first control signal and connected between a second voltage and the first node;

a third switching transistor controlled by the second control signal and connected between the second node and the second voltage;

a fourth switching transistor controlled by the first control signal and connected between the second node and the output terminal of the driving transistor;

a fifth switching transistor controlled by the first control signal and connected between the light emitting element and the output terminal of the driving transistor; and a sixth switching transistor controlled by a third control signal and connected between the control terminal and the input terminal of the driving transistor.

17. The device of claim 16, wherein the first switching transistor and the fourth switching transistor are different channel types than the second switching transistor and the fifth switching transistor.

18. The device of claim 17, wherein the driving transistor, the second switching transistor, and the fifth switching transistor are p-channel field effect transistors.

19. The device of claim 18, wherein, in a first period, a second period, a third period, and a fourth period that continue in sequence, the first switching transistor, the third switching transistor, and the fourth switching transistor are on, and the second switching transistor, the fifth switching transistor, and the sixth switching transistor are off during the first period, the first switching transistor and the fourth switching transistor are on, and the second switching transistor, the third switching transistor, the fifth switching transistor, and the sixth switching transistor are off during the second period, the second switching transistor and the fifth switching transistor are on, and the first switching transistor, the third switching transistor, the fourth switching transistor, and the sixth switching transistor are off during the third period, and the second switching transistor, the fifth switching transistor, and the sixth switching transistor are on, and the first switching transistor, the third switching transistor, and the fourth switching transistor are off during the fourth period.

20. A method of driving a display device comprising a light emitting element, a capacitor connected between a first node and a second node, and a driving transistor comprising an input terminal, an output terminal, and a control terminal connected to the second node, the method comprising:

connecting a data voltage to the first node while connecting the second node to the output terminal of the driving transistor;

connecting a second voltage to the second node;

disconnecting the second node from the second voltage;

connecting the second voltage to the first node and connecting the light emitting element to the output terminal of the driving transistor; and connecting the control terminal and the input terminal of the driving transistor.

21. The method of claim 20, further comprising:

disconnecting the control terminal from the input terminal of the driving transistor after connecting the control terminal and the input terminal.

22. The method of claim 21, wherein connecting the second voltage to the second node and disconnecting the second node from the second voltage are sequentially performed in a state in which the data voltage is connected to the first node and the second node is connected to the output terminal, and wherein connecting the second voltage to the first node and connecting the light emitting element to the output terminal of the driving transistor are performed in a state in which the second node and the second voltage are disconnected.

* * * * *